US006799937B2

(12) United States Patent
Granroth et al.

(10) Patent No.: US 6,799,937 B2
(45) Date of Patent: Oct. 5, 2004

(54) HIGH VISIBILITY TRAVERSABLE BOOM SYSTEM

(75) Inventors: Mark D. Granroth, Baraga, MI (US); Jon Hoke, Alvin, TX (US)

(73) Assignee: Pettibone, L.L.C., Downers Grove, IL (US)

( * ) Notice: Subject to any disclaimer, the term of this patent is extended or adjusted under 35 U.S.C. 154(b) by 0 days.

(21) Appl. No.: 10/414,684

(22) Filed: Apr. 14, 2003

(65) Prior Publication Data

US 2003/0198550 A1 Oct. 23, 2003

Related U.S. Application Data

(63) Continuation of application No. 09/882,009, filed on Jun. 15, 2001, now abandoned, which is a continuation-in-part of application No. 09/286,152, filed on Apr. 5, 1999, now abandoned.

(60) Provisional application No. 60/232,786, filed on Sep. 15, 2000.

(51) Int. Cl.[7] ..... B66F 9/00

(52) U.S. Cl. ..... 414/696; 414/685; 414/718

(58) Field of Search ..... 414/680, 685, 414/696, 408, 749.1, 718, 728; 294/224

(56) References Cited

U.S. PATENT DOCUMENTS

| | | | | |
|---|---|---|---|---|
| 2,411,022 A | | 11/1946 | Botnick | |
| 3,198,359 A | | 8/1965 | Lull | |
| 3,967,744 A | | 7/1976 | Goyarts | |
| 4,147,263 A | * | 4/1979 | Frederick et al. | 414/718 |
| 4,162,873 A | | 7/1979 | Smith, Jr. | |
| 4,278,390 A | | 7/1981 | Ahearn | |
| 4,336,720 A | | 6/1982 | Prokop et al. | |
| 4,383,792 A | | 5/1983 | Seabloom et al. | |
| 4,676,713 A | | 6/1987 | Voelpel | |
| 4,683,802 A | | 8/1987 | Prokop et al. | |
| 4,815,357 A | | 3/1989 | Truehart | |
| 4,954,041 A | | 9/1990 | Dahlquist et al. | |
| 5,240,366 A | | 8/1993 | Bamford | |

* cited by examiner

*Primary Examiner*—Donald W. Underwood
(74) *Attorney, Agent, or Firm*—McDermott Will & Emery LLP

(57) ABSTRACT

The present invention relates to a forklift having a traversing carriage for moving longitudinally along a frame of the forklift, an outer guide rail for guiding the carriage being disposed relatively low to the operator cockpit so as to minimize the obstruction of operator visibility of the surrounding terrain.

20 Claims, 6 Drawing Sheets

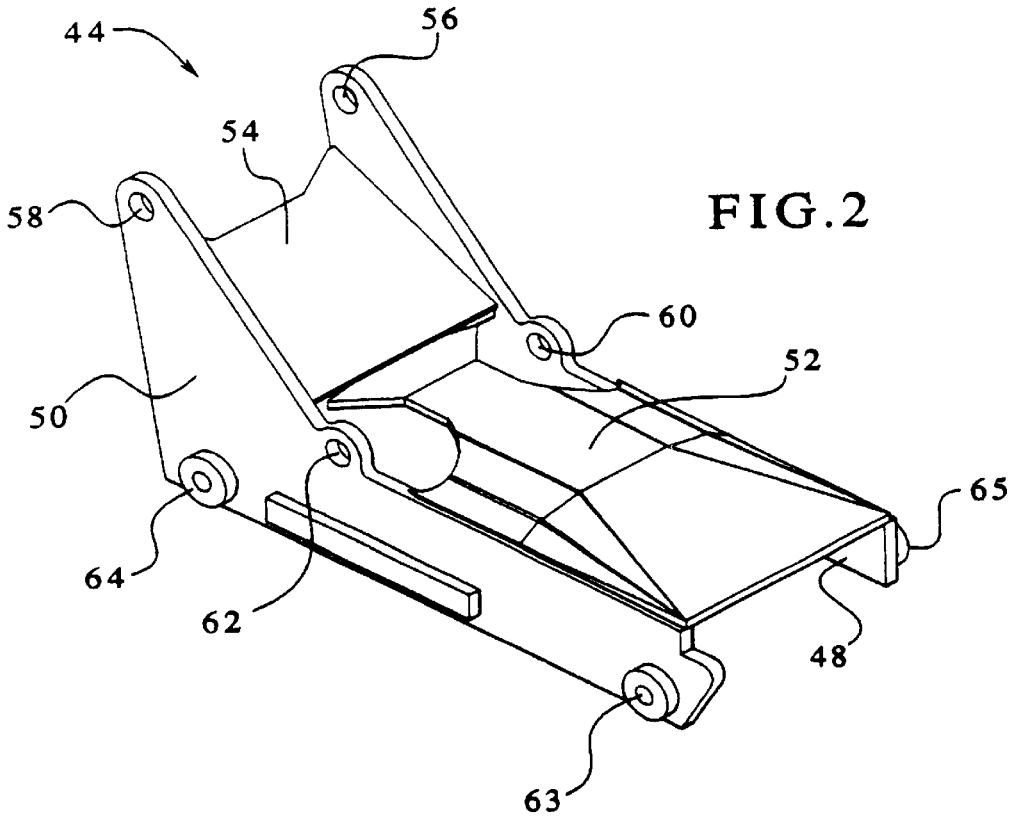
FIG.2
FIG.3
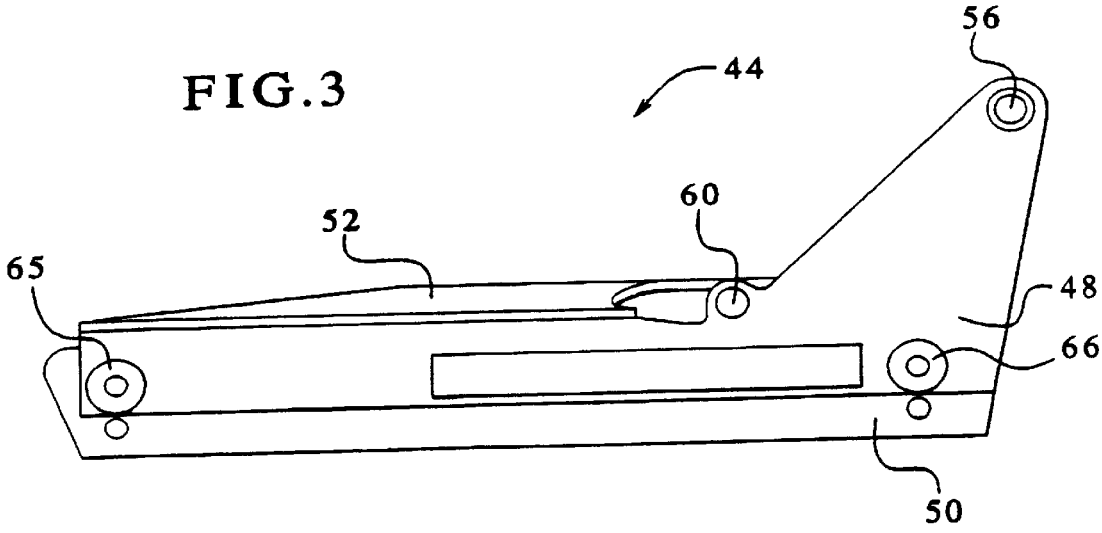

HIGH VISIBILITY TRAVERSABLE BOOM SYSTEM

This application is a continuation of U.S. Patent application Ser. No. 09/882,009, filed on Jun. 15, 2001, now abandoned which is a continuation-in-part of U.S. Patent application Ser. No. 09/286,152, filed Apr. 5, 1999, entitled "High Visibility Rough Terrain Forklift with Tight Turning Radius and Extensible Boom," now abandoned, and claims priority to Provisional Patent Application No. 60/232,786, filed Sep. 15, 2000, hereby incorporated by reference.

FIELD OF THE INVENTION

The present invention relates generally to a traversing boom system. More particularly, the present invention relates to a traversing boom system for a forklift providing a high degree of operator visibility.

BACKGROUND OF THE INVENTION

Forklifts have long been known in the construction industry and typically comprised a frame having a front and rear set of opposing wheels, an engine and drivetrain, an operator cockpit, and a load handling attachment at the end of a boom. Forklifts having a high level of maneuverability were usually preferred for the transport and placement of loads in and around construction sites. The typical construction site also required, for safe and efficient operation, that a forklift provide its operator with a high level of visibility of the terrain surrounding the forklift. Such a forklift is described in application Ser. No. 09/286,152 which is incorporated herein by reference and of which this application is a continuation-in-part. Operator visibility of the terrain surrounding a forklift was crucial to avoid injury to personnel working thereabout and to avoid damaging nearby structures, waterlines or electrical lines. When provided with a high degree of visibility of the surrounding terrain, an operator could quickly and efficiently operate the forklift with confidence it was being done safely.

Prior to transporting a load, a forklift operator would usually engage the load with the load handling attachment at the end of the boom, lift the load from the surface upon which it rested by elevating the boom, and adjust the boom and load to a transport configuration. The transport configuration positioned the load at a sufficient distance from the ground to ensure that neither the load nor the load handling attachment of the boom would inadvertently encounter the ground during transportation. The load elevation varied according to the terrain and would necessarily be greater when the terrain was rough than when the terrain was relatively even. Stability dictated, however, that the load not be positioned too far above the forklift center of gravity. Other aspects of the environment in which the forklift was used also limited the elevation of the load in the transport configuration. For example, a forklift employed to move a load from a construction site into a building might have been required to pass through a doorway. At that time, the vertical elevation of the boom, load handling attachment or load could be no higher than the vertical opening of the doorway.

Forklifts having a variable reach or extensible boom were also well known in the construction industry. An extensible boom was usually pivotally connected to the forklift's frame, at, for example, a rearward portion thereof, and extended forward over the frame. The operator cockpit was typically mounted at the side of the frame between the front and rear wheels. The engine was often placed at the side of the frame opposing the operator cockpit or at the rear of the frame adjacent to the pivotal connection between the boom and the frame. As known to those of ordinary skill in the art, the extensible boom was employed to facilitate the handling of a load at a location to which the forklift could not travel. For example, placement or retrieval of a load on a second or higher floor of a building could require the forklift operator to elevate and extend the boom to place or retrieve the load.

Alternatively, some forklifts have mounted the boom pivot to a traversing boom carriage capable of travelling along portions of the forklift length rather than being pivotally mounted directly to the forklift's frame in a fixed manner. Traversing boom carriages typically employed a hydraulically controlled boom carriage mounted to a pair of parallel rails that enabled the boom carriage, and thus the boom attached thereto, to traverse the rails longitudinally towards the front or rear of the forklift frame.

As is known to one of ordinary skill in the art, traversing boom carriages were employed to increase the load handling ability of a forklift. For example, delivery of a load to the second or higher floor of a building with a fixed boom-pivot required raising the boom to the necessary angle, extending the boom to the approximate desired length to positioning the load handling device adjacent to the delivery area and then performing an iterative process involving adjusting the length and height of the boom to transport the load laterally to the desired position while maintaining the load of a constant elevation. A traversing boom carriage eliminated this iterative process by allowing the forklift operator to position the load adjacent to the delivery area and simply causing the boom carriage to traverse forward to locate the load in the delivery area. The traversing carriage provided a simple manner of obtaining lateral movement of the load while maintaining it at a relatively constant elevation.

The traversing carriage of the traversing boom type forklift added a new factor to the transport configuration of forklifts. As known to those skilled in the art, the boom carriage was typically positioned at or near its rearward most position at the rear of the forklift frame for stability. However, the guide rails along which the carriage traveled, as well as the carriage itself, obstructed the forklift operator's view of the terrain on the side of the forklift opposite the operator's cockpit when the forklift was in the transport configuration. The outermost guide rails and the carriage became the limiting factors of operator visibility of that terrain.

SUMMARY OF THE INVENTION

It is one of the principal objectives of the present invention to provide a rough terrain forklift that provides optimum terrain visibility to an operator.

It is another objective of the present invention to provide a forklift having a boom pivotally mounted on a traversable carriage and an engine mounted between frame rails.

It is still another objective of the present invention to provide a forklift having a low overall profile and optimum terrain visibility to an operator.

It is yet another objective of the present invention to provide a forklift having a traversing boom carriage.

It is another objective of the present invention to provide a forklift having a traversing boom carriage mounted on guide rails that facilitate optimum operator visibility of the terrain surrounding the forklift.

It is an additional objective of the present invention to provide a forklift having a traversing boom carriage mounted on a pair of guide rails, one or both of which are located low on the forklift to facilitate optimum operator visibility of the terrain surrounding the forklift.

It is a further objective of the present invention to provide a forklift having a pair of boom carriage guide rails, the outer one of the guide rails being lower than the inner guide rail.

It is yet another objective of the present invention to provide a traversing boom carriage for a forklift having the outer one of a pair of legs longer than the inner one of the pair of legs to accommodate a vertical offset of a pair of corresponding guide rails on the forklift.

It is still another objective of the present invention to provide a traversing boom forklift in which the carriage is guided by a single set of guide tracks.

These and other objectives of the present invention will become apparent upon review of the attached written description including the figures and claims.

BRIEF DESCRIPTION OF DRAWINGS

FIG. 2 is a perspective view of one embodiment of the traversing boom carriage of the present invention.

FIG. 3 is a left side elevational view of the traversing boom carriage depicted in FIG. 2.

Detailed Description

Figure 1:
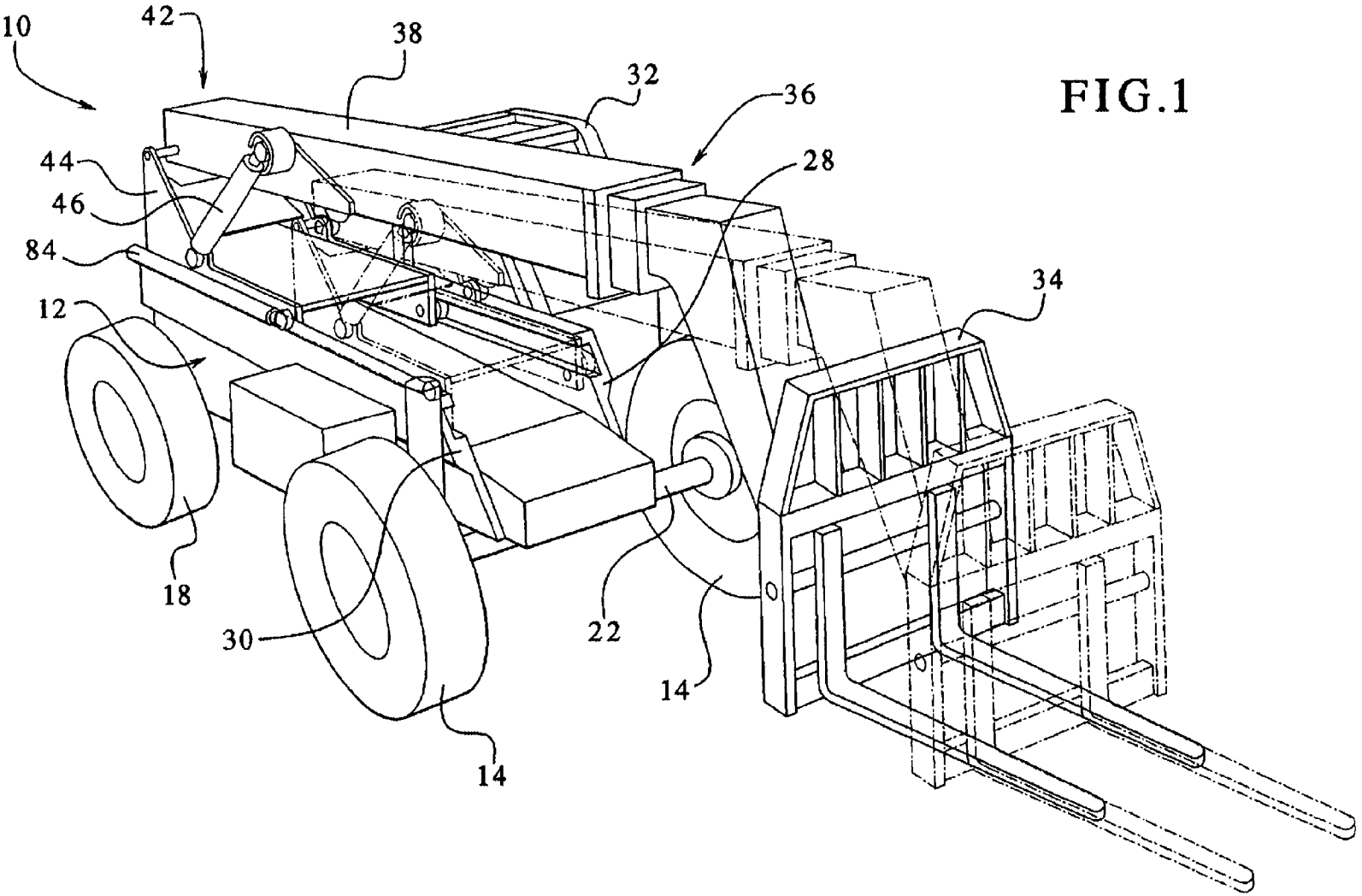
FIG. 1 is a perspective view of one embodiment of the forklift of the present invention with a traversing boom carriage in a rearward position and showing, in phantom, the boom carriage in a forward position.

FIG. 1 illustrates a perspective view of a forklift 10 representing one embodiment of the present invention. As shown in FIG. 1, the forklift 10 comprises a mainframe 12 with a front set of wheels 14 and a rear set of wheels 18 coupled to a front axle 22 and a rear axle (not shown) respectively. An engine 26 (see FIG. 5) and drivetrain (not shown) are located between a left frame rail 28 and a right frame rail 30 of the mainframe 12 to deliver power to the front 22 and/or rear (not shown) axles. An engine casing (not depicted) may enclose the engine 26 to protect the engine 26 from foreign objects and to protect the operator from injury. A cockpit 32 is mounted to the left frame rail 28 of the mainframe 12 for housing an operator 88 (See FIG. 5). Additionally, the cockpit 32 houses controls (not shown) known to one of ordinary skill in the art for operating the various mechanical features described herein.

A load handling device 34 is pivotally mounted to a first end 36 of a boom 38. Other handling devices, such as a loading fork, bucket, crane hook, or other load handling device known in the art, may be employed with the present invention. The boom 38 shown in FIG. 1 is a telescoping extensible boom. The boom 38 may alternatively be a fixed length boom, or other boom known in the art. The load handling device 34 is selectively tiltable using a hydraulic load handling cylinder (not shown) as is known to those skilled in the art.

A second end 42 of the boom 38 is pivotally mounted to a boom carriage 44. Two hydraulic boom cylinders 46 are connected between the boom 38 and the boom carriage 44 along either side of the boom carriage 44. The hydraulic boom cylinders 46 operate to raise and lower the boom first end 36. As the hydraulic boom cylinders 46 extend to raise the boom first end 36 the load handling cylinder may contract to maintain the load handling device 34 level to the ground. Similarly, as the hydraulic boom cylinders 46 contract to lower the boom 38, the load handling cylinder may extend to maintain the load handling device 34 level to the ground. The load handling cylinder may be extended or contracted independent of the hydraulic boom cylinders 46.

The embodiment depicted in FIG. 1 is a rough terrain forklift 10 allowing a tight turning radius, having a low profile, a centrally mounted engine 26 and drivetrain and the mainframe 12 as described in application Ser. No. 09/286,152. Additionally, the pivotal mount of the boom 38 is elevated from the mainframe 12 to provide the operator 88 of the forklift 10 with optimum visibility of the terrain surrounding the forklift 10 as described in application Ser. No. 09/286,152. The boom carriage 44 and rail configuration of the present invention can be employed with any type of boom, hydraulic system, or frame configuration.

FIGS. 2 and 3 illustrate one embodiment of the boom carriage 44 of the present invention. The boom carriage 44 has a left side plate 48 and a right side plate 50. The side plates 48, 50 are each affixed one to the other by a top brace 52 and a diagonal brace 54 which extend therebetween. The carriage depicted in FIG. 1 shows top and diagonal braces 52, 54 of different configurations than those depicted in FIG. 2. Other configurations will become evident to one of ordinary skill in the art. The braces 52, 54 can be affixed to the side plates 48, 50 by any other manner known in the art. The side plates 48, 50 each provide a boom pivot 56, 58 respectively, for rotatably mounting the boom 38 thereto as well as hydraulic support portions 60, 62 respectively, for attaching the hydraulic boom cylinders 46 thereto. Mounting of the boom 38 and hydraulic boom cylinders 46 to the boom carriage 44 may be accomplished in any manner known to those of ordinary skill in the art.

Each side plate 48, 50 comprises a guide track engaging portion, which in FIG. 2 comprises rollers 63, 64, 65, 66 rotatably mounted thereto. The carriage right side plate 50 is provided with a front roller 63 and a rear roller 64. The carriage left side plate 48 is provided with a front roller 65 and a rear roller 66. The rollers 63, 64 attached to the carriage right side plate 50 may be referred to herein collectively as the outer rollers 63, 64 (indicating the outermost relationship of the rollers 63, 64 with respect to the operator) and the rollers 65, 66 attached to the carriage left side plate 48 may be referred to herein collectively as the inner rollers 65, 66 (indicating the innermost relationship of the rollers 65, 66 with respect to the operator 88). Other guide track engaging portions consistent with the principles set forth herein are contemplated.

As shown in FIG. 3, the carriage right side plate 50 is longer than the carriage left side plate 48 so that it extends farther below the top brace 52 so as to vertically offset the outer rollers 63, 64 below the inner rollers 65, 66. In one embodiment, the outer rollers 63, 64 are vertically offset approximately 4.5 inches below the inner rollers 65, 66, as measured from their respective axes of rotation. That is, the outer rollers 63, 64 are located approximately 4.5 inches farther below the top brace 52 than are the inner rollers 65, 66. As described more fully below, the outer rollers 63, 64 engage an outer guide track 83 and the inner rollers engage an inner guide track 81 to guide the carriage 44 as it traverses the forklift 10.

Figure 6:
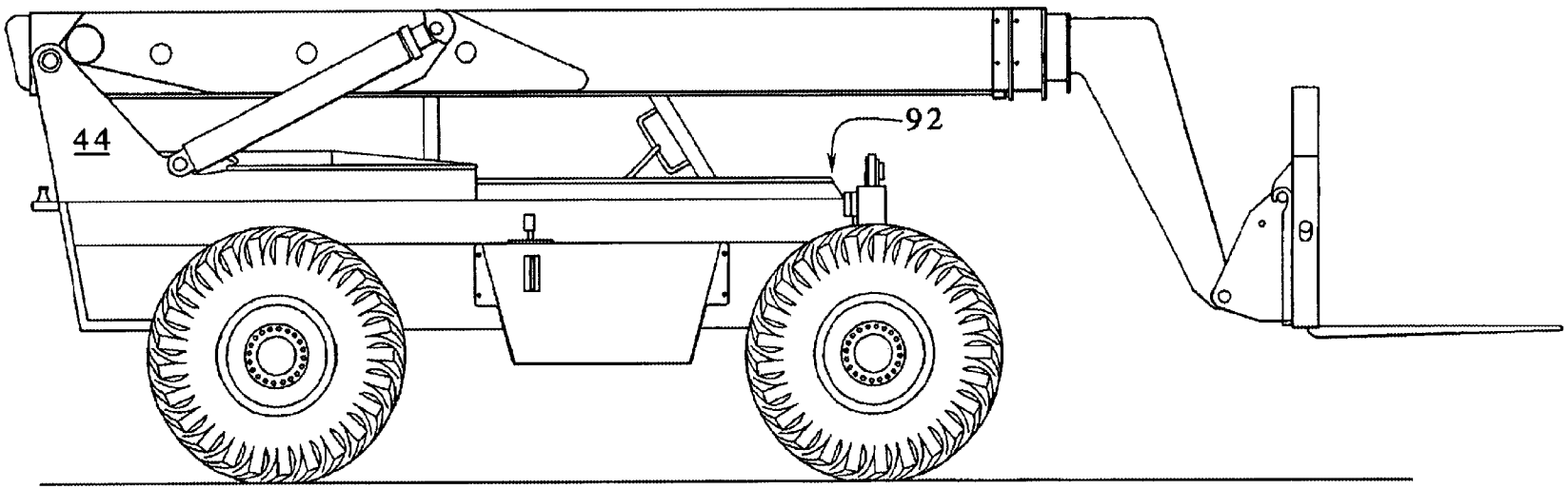
FIG. 6 is a right side elevational view of one embodiment of the forklift of the present invention with the boom carriage in a rearward position.

In one embodiment, the overall length of the boom carriage 44 has a relatively shorter length than previous carriages, enabling the boom carriage 44 to be further removed from an operator's view when in a rearward position such as when configured for travel as depicted in FIG. 6. In one embodiment, the boom carriage 44 is approximately 83 inches long, as measured from the centerline of the front left roller 65 to the centerline of the rear left roller 66. According to well known principals of physics, shortening the length of the boom carriage 44 increases the loads experienced by the rollers 63, 64, 65, 66 due to the moment created by the weight of the load and the boom 38. The shorter carriage length reduces the moment arm of the boom carriage 44, which increases the amount of force exerted on the rollers 63, 64, 65, 66 and, therefore, the guide tracks 81, 83. In one embodiment, the increased loads are partially sustained by using larger diameter rollers 63, 64, 65, 66 than previous designs. For example, the rollers 63, 64, 65, 66 are approximately 5⅞ inches in diameter in one embodiment. The rollers 63, 64, 65, 66 may utilize roller bearings, as opposed to the bronze bushings used in past designs, to help compensate for the increased loading caused by the shortened boom carriage 44 of this embodiment. Other carriage lengths and roller diameters, consistent with the principals set forth herein, are contemplated.

Figure 4:
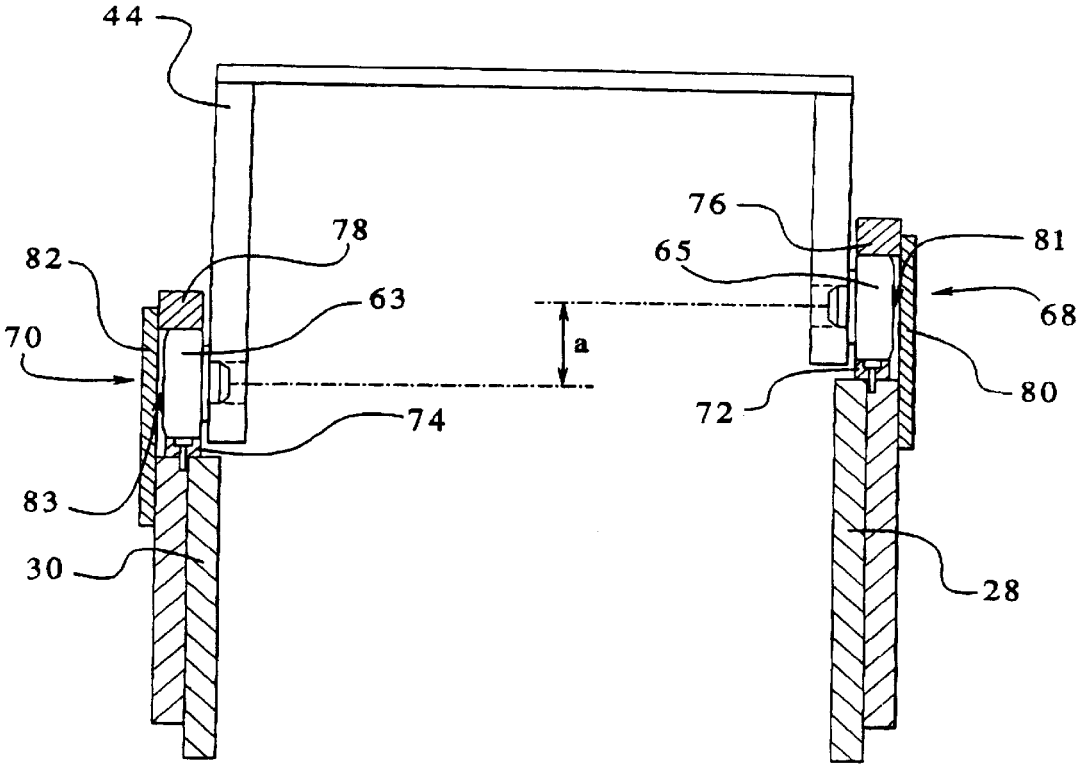
FIG. 4 is a front side cross-sectional view of one embodiment of the guide rails of the present invention and an elevational view of the carriage of the present invention mounted therein.

As shown in FIG. 4, the left frame rail 28 comprises an inner guide rail 68 and the right frame rail 30 comprises an outer guide rail 70. The terms inner and outer are again used with reference to the cockpit 32 and the operator 88 therein. The outer guide rail 70 is vertically offset from the inner guide rail 68 to accommodate the offset between the outer rollers 63, 64 and the inner rollers 65 and 66. The inner and outer guide rails 68, 70 respectively each have a lower rail portion 72, 74, an upper rail portion 76, 78, and a side rail portion 80, 82, respectively, defining an inner guide track 81 and an outer guide track 83 to accommodate the guide track engaging portions depicted as inner rollers 65, 66 and outer rollers 63, 64 respectively. Lower rail portions 72, 74, may, optionally, be readily replaceable to absorb the wear and tear to which the lower rail portions 72, 74 are subjected. In this embodiment, the lower rail portions 72, 74 are replaceably secured to the respective upper rail portions 76, 78 by bolts, as shown, or by any other manner known to those of ordinary skill in the art. The rollers 63, 64, 65, and 66 operate within the respective guide tracks 81, 83 allowing the boom carriage 44 to traverse the guide rails 68, 70 in the conventional manner of traversing boom forklifts as will be understood by one of ordinary skill in the art. The figures depict the right front roller 63 and the right rear roller 64 both being accommodated in the outer guide track 83 as well as the left front roller 65 and the left rear roller 66 both being accommodated in the inner guide track 81. This configuration differs to prior traversing boom configurations that employed a pair of opposing upper guide tracks for the rear rollers and a distinct pair of opposing lower guide tracks for the front rollers to vertically offset the front rollers from the rear rollers. Eliminating this vertical offset in the present invention allows the guide tracks to be lowered the maximum amount to provide the maximum visibility of the terrain possible. Manufacture of the present guide tracks 81, 83, is also simpler than prior guide tracks. It will become evident to one of ordinary skill in the art, however, that the offset of the present invention between the inner and outer rails could be accomplished, with concomitant benefits, on a forklift employing separate pairs of guide tracks for the front and rear rollers.

The rollers 63, 64, 65, 66 are accommodated in the guide rails 68, 70 such that each roller 63, 64, 65, 66 contacts either the lower rail portion 72, 74 or the upper rail portion 76, 78 depending on the loading of the boom carriage 44. For example, generally, when the load 20 handling device 34 is loaded, a downward force is transferred through the boom carriage 44 in front of the center of gravity of the boom carriage 44, the moment created by the load will cause the front rollers 63, 65 to ride along the lower rail portions 72, 74 and the rear rollers 64, 66 to ride along the upper rail portions 76, 78. The side rail portions 80, 82 provide lateral support to the rollers 63, 64, 65, 66 and are configured to prevent the boom carriage 44 from escaping the guide tracks 81, 83 defined by the guide rails 68, 70.

In one embodiment, the height of the guide rails 68, 70, measured from the lowest surface of the lower rail portion 72, 74 to the uppermost surface of the upper rail portion 76, 78, is approximately 8.66 inches. The height of the guide tracks 81, 83, measured from the lowest surface of the upper rail portion 76, 78 to the uppermost surface of the lower rail portion 72, 74, is approximately 5.91 inches. The width of the guide rails 68, 70, measured from the innermost surface to the outermost surface of the guide rails 68, 70, is approximately 2.8 inches. The thickness of the side rail portions 80, 82 is approximately 0.75 inches. The thickness of the lower rail portion 72, 74 is approximately 0.75 inches. The thickness of the upper rail portion 76, 78 is approximately 2.0 inches. Additionally, in this embodiment, the guide rails 68, 70 may be constructed of welded steel plates. Alternatively, the guide rails 68, 70 may be constructed from formed steel channels formed, by way of example only, by extrusion. In the embodiment depicted in FIGS. 1 and 4, guide rails 68, 70 are attached to the frame rails 28, 30, respectively, by welding. Alternate methods of attaching the guide rails 68, 70 to the frame rails 28, 30, such as bolting, will be evident to one of ordinary skill in the art. The guide tracks 81, 83 of the present invention may alternatively be formed into the frame rails 28, 30 themselves, such as by forging or machined therein. Other methods for providing the guide tracks 81, 83 of the present invention will become apparent to one of ordinary skill in the art.

As described above with respect to FIGS. 2 and 3, the outer rollers 63, 64 are located approximately 4.5 inches below the inner rollers 65, 66 in one embodiment. This offset is illustrated in FIG. 4 as distance a. Other magnitudes of offset a are contemplated. In the same embodiment, the center of the outer guide track 81 is located approximately 4.5 inches, or other dimension a, lower than the center of the inner guide track 83 to accommodate the offset of the rollers 63, 64, 65, 66. Offsetting the guide tracks 81, 83 lowers the uppermost surface of the outer guide rail 70 thereby increasing the operator's visibility of the terrain thereadjacent by a distance b as depicted in FIG. 5B. The inner guide rail 68 may also be lowered with respect to prior inner guide rails. Indeed, in one embodiment of the present invention, which is not depicted, the inner guide rail 68 is lowered to an elevation equal to the outer guide rail 70 and the carriage left and right side plates 48, 50 are, accordingly, of equal length.

In either configuration, the carriage left and right side plates 48, 50 must be of sufficient height to elevate the carriage top brace 52 over the engine. 26 or other equipment which resides between the frame rails 28, 30. However, when physical limitations prevent the lowering of the inner guide rail 68 to the same lowered elevation as desired for the outer guide rail 70, the vertical offset a of the present invention as depicted in FIGS. 4, 5, 5A and 5B provide increase terrain visibility without requiring a lowered inner guide rail 68. Such physical limitations may include, by way of example only, mountings (not depicted) for the cockpit 32 or access holes in the inner frame rail 28 to provide access to the engine, transmission or drivetrain.

The lower limit of the outer guide rail 70 will be dictated by the desired ground clearance and the desired maximum loading capability of the forklift 10. In one embodiment, it has been found that the inner and outer frame rails 28 and 30 need be approximately 16 inches high and 21.5 inches high, respectively, when comprised of approximately 1.5 inch thick welded plate steel for a forklift 10 having a recommended lifting capacity of 8,000 lbs. Other configurations are contemplated and will be recognized by one of ordinary skill in the art.

One or more of the rollers 63, 64, 65, 66 may comprise a thrust slide or an adjustable roller with a cam-like mechanism for adjusting its thrust, or position of the roller 63, 64, 65, 66 from side to side. For example, the inner rollers 65, 66 may be adjustable rollers and the outer rollers 63, 64 may be fixed rollers to promote acquiring a perfect fit between the boom carriage 44 and the offset guide rails 68, 70 during the assembly of the forklift 10.

The traversing motion of the boom carriage 44 along the guide rails 68, 70 may be facilitated by one or a pair of carriage hydraulic cylinders 84, one located along each of the guide rails 68, 70. As shown in FIG. 1, the offset rails 68, 70 may traverse the length of the mainframe 12 allowing the boom carriage 44 to traverse the length of the mainframe 12. FIGS. 1 and 6 depict the boom carriage 44 in a fully rearward, or nearly fully rearward, position which may constitute a transport configuration. The transport configuration is designed to promote a higher degree of visibility when the forklift 10 is in motion as well as to allow transport of the forklift 10 without the load encountering the earth. In the transport configuration, the boom carriage 44 is entirely out of the line of sight of the operator 88 housed in the cockpit 32 when looking towards the terrain adjacent to the outside rail 70. Therefore, as depicted in FIG. 6, the short length of the boom carriage 44 of the present invention assures that the increased operator visibility provided by the lowered outer guide rail 70 of the present invention is appreciable by the operator. Moreover, locating the engine 26 immediately below the carriage 44 in its depicted location in FIG. 6 assures that the engine 26 remains out of the sight of the operator regardless of the position of the carriage 44. FIG. 6 also depicts a front carriage stop 92 proximate the foremost portion of the guide rails 68, 70. A rear carriage stop (not depicted) may also be located proximate to the rearmost portion of the guide rails 68,70. FIG. 1 also illustrates, in phantom, the boom carriage 44 in a forward position.

Figure 5A:
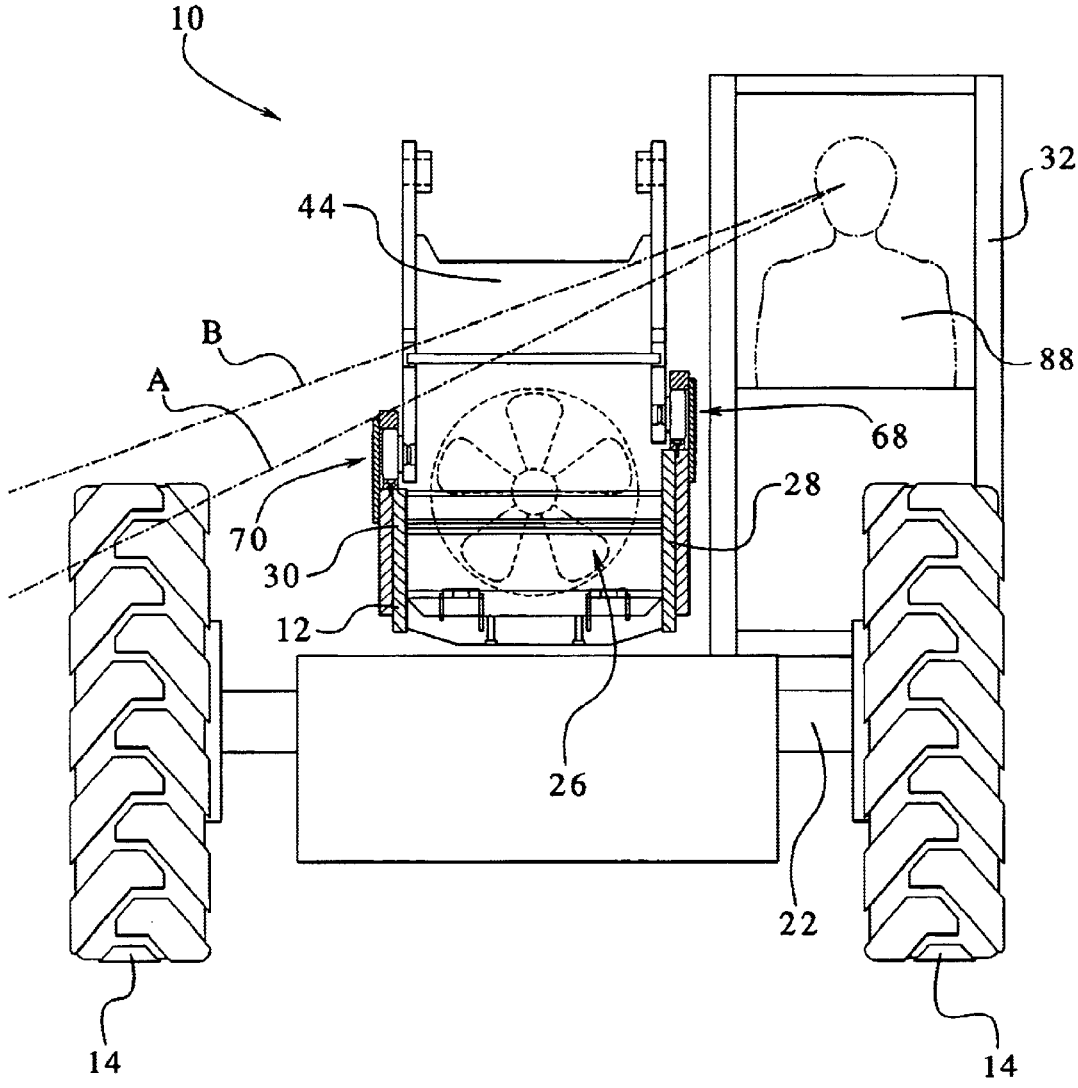
FIG. 5A is a front side elevational view of one embodiment of the forklift of the present invention with the frame and guiderails in cross-section to illustrate the operator's line of sight over the frame to the terrain adjacent to the carriage guide rails as well as the operator's line of sight if the outer guide rails were of equal elevation to the inner guide rail as with prior art traversing boom guide rails.
Figure 5B:
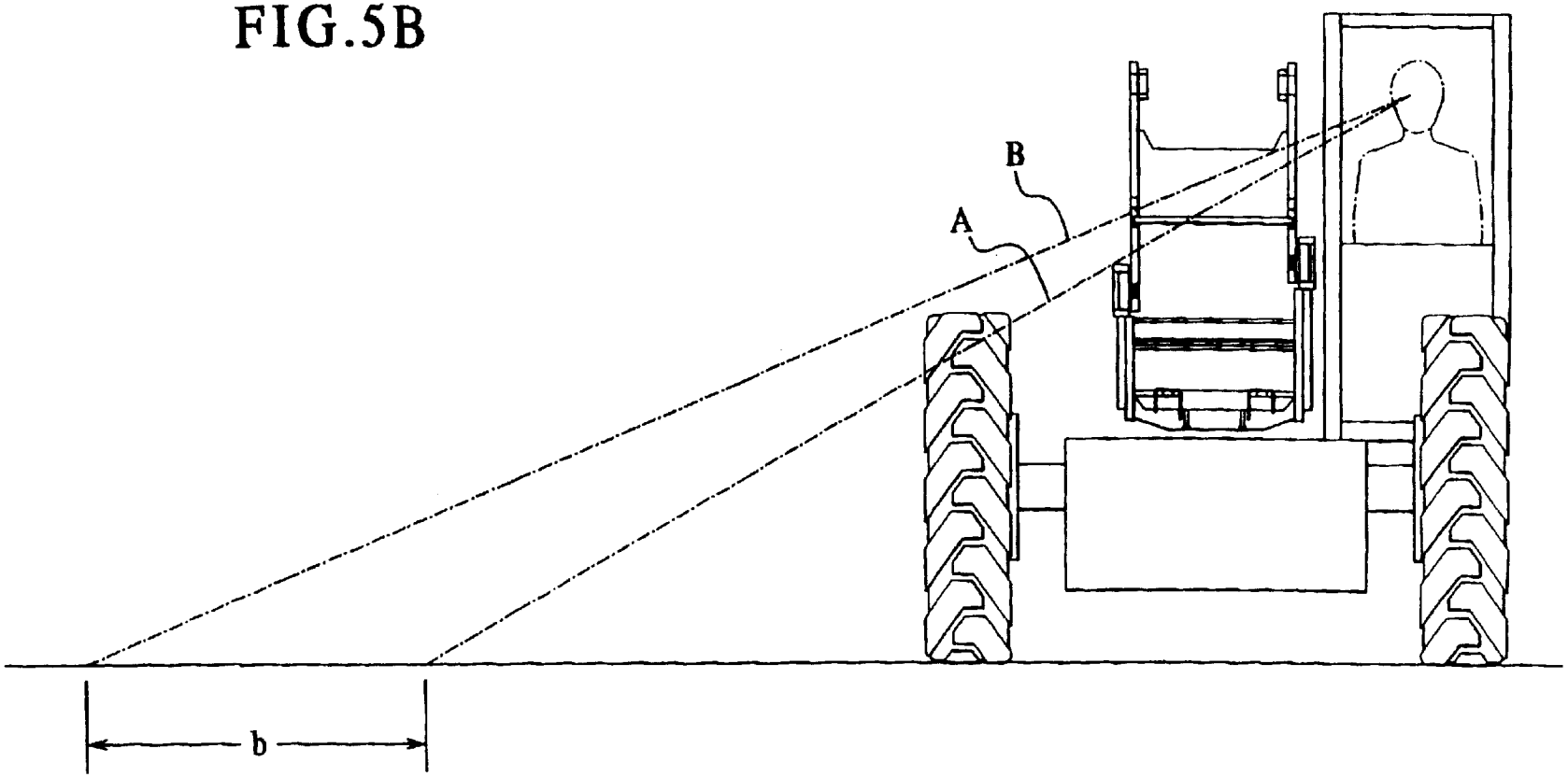
FIG. 5B is a broader view of the illustration of FIG. 5A indicating the increased view of the terrain provided by the embodiment of the present invention depicted in FIG. 5A.

FIG. 5A illustrates the increased visibility provided by the offset guide rails 68, 70. As described above, the cockpit 32 is located along the left frame rail 28. When the operator 88 housed in the cockpit 32 looks towards the terrain adjacent to the right frame rail 30, and the boom carriage 44 is in a rearward position to remove it from the operator's line of sight, the operator's view is limited by the height of the outer guide rail 70. In FIG. 5, the operator's line of sight over the offset guide rails 68, 70 of the present invention is demonstrated by line A. Line B illustrates what the operator's line of sight would have been had the outside guide rail 70 been located at an elevation equal to the inner guide rail 68 in the traditionally configuration. FIG. 5B demonstrates the additional terrain which the operator is able to view as a result of the present invention. By lowering the outside guide rail 70 of the present invention the operator's view of the surrounding terrain is increased by the distance b shown in FIG. 5B.

Although the engine 26 and drivetrain may be mounted to the mainframe 12 in a number of configurations, using the offset rails 68, 70, in conjunction with a centrally mounted engine 26 and drivetrain affords a further increase of visibility.

For all of the above reasons, the forklift 10 of the present invention increases an operator's visibility of the surrounding terrain.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A boom assembly comprising:

a boom connected to a boom carriage facilitating translational motion of the boom, the boom carriage comprising, a first carriage side plate having a guide track engaging portion to engage a first guide track, the first carriage side plate defining a first length;

a second carriage side plate having a guide track engaging portion to engage a second guide track, the second carriage side plate defining a second length longer than the first carriage side plate length, the second carriage side plate being located laterally of the first carriage side plate in substantially a side-by-side relationship with respect to the direction of the boom translational motion facilitated by the boom carriage.

2. The carriage of claim 1, the guide track engaging portions of the first side portion and the second side portion further comprise a plurality of rollers rotatably mounted to the rail engaging portions.

3. The carriage of claim 2, one or more of the rollers being fixed rollers.

4. The carriage of claim 2, one or more of the rollers being adjustable rollers.

5. The carriage of claim 1, the second length is approximately 4.5 inches longer than the first length.

6. The carriage of claim 1, the carriage side plates further comprise a boom pivot pin for rotatably mounting the boom thereto.

7. The carriage of claim 1, the carriage side plates further comprise one or more hydraulic support portions for attaching one or more hydraulic cylinders thereto.

8. A forklift comprising:

a mainframe having a first guide track and a second guide track both located laterally adjacent to a forklift cockpit, the first and second guide tracks accommodating a traversing boom carriage to facilitate translational motion of the traversing boom carriage, the second guide track being located laterally of the first guide track with respect to the direction of translational motion of the traversing boom carriage, an uppermost portion of the first guide track defining a horizontal plane passing therethrough and an uppermost portion of the second guide track defining a second horizontal plane passing therethrough, the first horizontal plane being above the second horizontal plane;

the traversing boom carriage traversably guided by the first and second guide tracks; and a boom connected to the boom carriage.

9. The forklift of claim 8 wherein the boom carriage further comprises a boom pivot for rotatably mounting the boom thereto, wherein, when configured for travel, the lower surface of the boom is located above the eye level of a typical operator.

10. The forklift of claim 8 wherein the boom carriage further comprises rollers for coupling the carriage to the first and second guide tracks.

11. The forklift of claim 10 wherein the rollers comprise at least one adjustable roller.

12. The forklift of claim 8 wherein the boom carriage further comprises one or more hydraulic support portions for coupling one or more hydraulic cylinders thereto.

13. The forklift of claim 12 wherein the hydraulic support portions further comprise at least one hydraulic support portion for attaching at least one hydraulic cylinder for operating a boom.

14. The forklift of claim 12 wherein the hydraulic support portions further comprise at least one hydraulic support portion for attaching at least one hydraulic cylinder for operating the traversing carriage.

15. The forklift of claim 8 wherein the first and second guide tracks are offset vertically by approximately 4.5 inches.

16. The forklift of claim 8 wherein the first and second guide tracks are attached to the mainframe.

17. The forklift of claim 8 wherein the first and second guide tracks are integrally formed within the mainframe.

18. The forklift of claim 8 wherein the mainframe is a substantially narrow mainframe.

19. The forklift of claim 8 further comprising an engine mounted beneath the guide tracks within the mainframe.

20. A forklift for providing a substantially unobstructed view of the surrounding terrain to an operator in an operator station, the forklift comprising:

a mainframe having a first guide track and a second guide track both located laterally adjacent to a forklift cockpit, the first and second guide tracks accommodating a traversing boom carriage to facilitate translational motion of the traversing boom carriage, the second guide track being located laterally of the first guide track with respect to the direction of translational motion of the traversing boom carriage, an uppermost portion of the first guide track being lower than an uppermost portion of the second guide track;

the traversing boom carriage rotatably affixed to a first roller located in the first guide track and a second roller located in the second guide track; and a boom connected to the boom carriage.

* * * * *